US005562497A

United States Patent [19]

Yagi et al.

[11] Patent Number: 5,562,497

[45] Date of Patent: Oct. 8, 1996

[54] SHIELDED PLUG ASSEMBLY

[75] Inventors: Masanori Yagi, Ebina; Goro Tokuyama, Yokohama; Yoshikazu Ito, Yamato; Hiroshi Ikesugi, Yokohama, all of Japan

[73] Assignee: Molex Incorporated, Lisle, Ill.

[21] Appl. No.: 440,578

[22] Filed: May 15, 1995

[30] Foreign Application Priority Data

May 25, 1994 [JP] Japan ..... 6-135152

[51] Int. Cl.[6] ..... H01R 9/03

[52] U.S. Cl. ..... 439/610; 439/607

[58] Field of Search ..... 439/607, 608, 439/609, 610, 931

[56] References Cited

U.S. PATENT DOCUMENTS 4,514,029 4/1985 Lax et al. ..... 439/931 X 5,108,313 4/1992 Adams ..... 439/610

5,199,903 4/1993 Asick et al. ..... 439/610

5,222,909 6/1993 Nomura et al. ..... 439/610 X 5,244,415 9/1993 Marsilio et al. ..... 439/610

5,429,529 7/1995 Hashizawa et al. ..... 439/610

*Primary Examiner*—Khiem Nguyen

*Attorney, Agent, or Firm*—Charles S. Cohen

[57] ABSTRACT

An improved shielded plug assembly includes a casing composed of two separate halves of material capable of absorbing electromagnetic waves. The casing encloses a flanged plug, the exposed conductors of an associated interconnect cable, a metal band binding the exposed braiding and the stripped end of the cable. The flange of the cable plug and the stripped end of the cable are sandwiched between the two halves of the shielded casing and held in place within the casing. A flexible covering has a cavity which receives the casing and its enclosed components and retains the assembly together.

19 Claims, 4 Drawing Sheets

SHIELDED PLUG ASSEMBLY

BACKGROUND OF THE INVENTION

The present invention relates generally to shielded electrical connectors which are used for interconnecting electronic components, such as computers and peripherals, together, and more particularly, to a shielded plug assembly for interconnecting such electrical components together having improved shielding characteristics.

Connectors are widely used in the computer field to interconnect various computer components together, such as the computer central processing unit to a peripheral device, such as, for example a printer, an ancillary hard drive unit or a CD-ROM drive. These type of connectors typically include an elongated cable with two connectors, typically plug-type connectors, at the opposing ends which connect with complementary receptacles formed in the bodies of the computer components. Some of these components have their own electrical drive systems which generate electromagnetic radiation during operation which is commonly referred to as "noise". This noise may interfere with the operation of the components and affect their performance because interfering signals may enter the electronic component through its input and output lines via the interconnecting cables. This noise may be suppressed down to an acceptable level by appropriate electromagnetic shielding located in part of the connector. Shielding is commonly provided in such connectors by providing a layer within the connector cable which consists of a circular metal braid and which extends the length of the cable.

The wire braiding may be typically joined to a sheet metal shell in the plugs at the ends of the interconnecting cables. Alternatively, a ring of noise suppression material may also be applied to the plug ends near where the internal conductors of the connector cable join to the connector engagement pins of the plug ends. In these two styles of plug connectors, the plug ends are composed of a number of parts, and thus are expensive to manufacture and require a great deal of labor in their assembly. The present invention is directed to an improved shielded connector assembly having an internal noise suppressing means disposed within the connector housing which requires fewer parts and less labor to assemble than the connectors of the prior art, and which further provides structural strength to the connectors.

SUMMARY OF THE INVENTION

Accordingly, it is a general object of the present invention to provide a shielded plug assembly for use in electronic component connectors which is composed of a least number of parts, thereby facilitating the assembling of such connectors and accordingly reducing the manufacturing cost.

Another object of the present invention is to provide an improved shielded plug assembly for use in component connectors in which two plug ends are connected by an elongated cable, and in which the plug ends include an integrated housing formed from an shielding material which substantially encloses the engagement pins of the connector within the plug ends.

To attain these and other objects, the present invention provides in one embodiment of the present invention, a shielded plug assembly having a length of shielded interconnect cable and a plug connector attached to at least one free end of the cable, the shielded cable having a plurality of exposed internal conductors adjacent the plug end, the internal shielding of the interconnect cable exposed and held in place upon the outer insulation of the cable by a metal band, the plug end including an internal shielding casing formed from a material capable of absorbing electromagnetic radiation.

In the preferred embodiment, the internal shielding casing encloses flanged portions of the plug end, the exposed conductors and the outer insulation near the open end of the cable. The suppression casing is preferably press-fit and fixed to at least a portion of the plug end at a surrounding flange thereof, and the terminal end of the outer insulation of the cable. With this arrangement, the single internal shielding casing substantially suppresses leakage of EMF radiation, or noise at the connections between the plug and the cable internal conductors as well as along the length of the interconnect cable during operation.

In accordance with the preferred embodiment, the shielding casing may have at least a first recess formed therein which receives the innermost flange of the plug end and a second recess formed therein which receives the cable shielding which is fixed to the terminal end of the outer insulation of the cable. With this arrangement, stretching of the interconnect cable which otherwise would tend to compromise the connection between the interconnect cable and the plug piece is substantially prevented. The internal shielding casing thereby encloses and isolates the connections between the interconnect cable internal conductors of the cable and the plug end from possible compromise or disassociation due to bending or stretching of the cable or plug piece.

In further accordance with the preferred embodiment, the internal shielding casing may include two half-casing portions of the same size and shape, thereby permitting the casing to be mass produced formed from a single mold cavity. Advantageously, each half-casing portion may be assembled into the plug assembly to form an integrated assembly simply by interengaging the half-casings and inserting them into a protective plastic sheath which completely encloses the shielding casing and the terminal end of the outer insulation of the cable. The casing may have an EMF radiation suppression coating thereon so that a wide range of radiation noise may be prevented. The plastic sheath may further be destaticized by applying an antistatic agent. The protective sheath will then have the effect of preventing storage of static electricity on the shielded-plug assembly as well as increasing the overall mechanical strength of the assembly.

These and other objects, features and advantages of the present invention will be apparent through a reading of the following detailed description, taken in conjunction with accompanying drawings, wherein like reference numerals refer to like parts.

BRIEF DESCRIPTION OF THE DRAWINGS

In the course of the description, reference will be made to the attached drawings in which.

DETAILED DESCRIPTION OF THE DETAILED EMBODIMENTS

Figure 4:
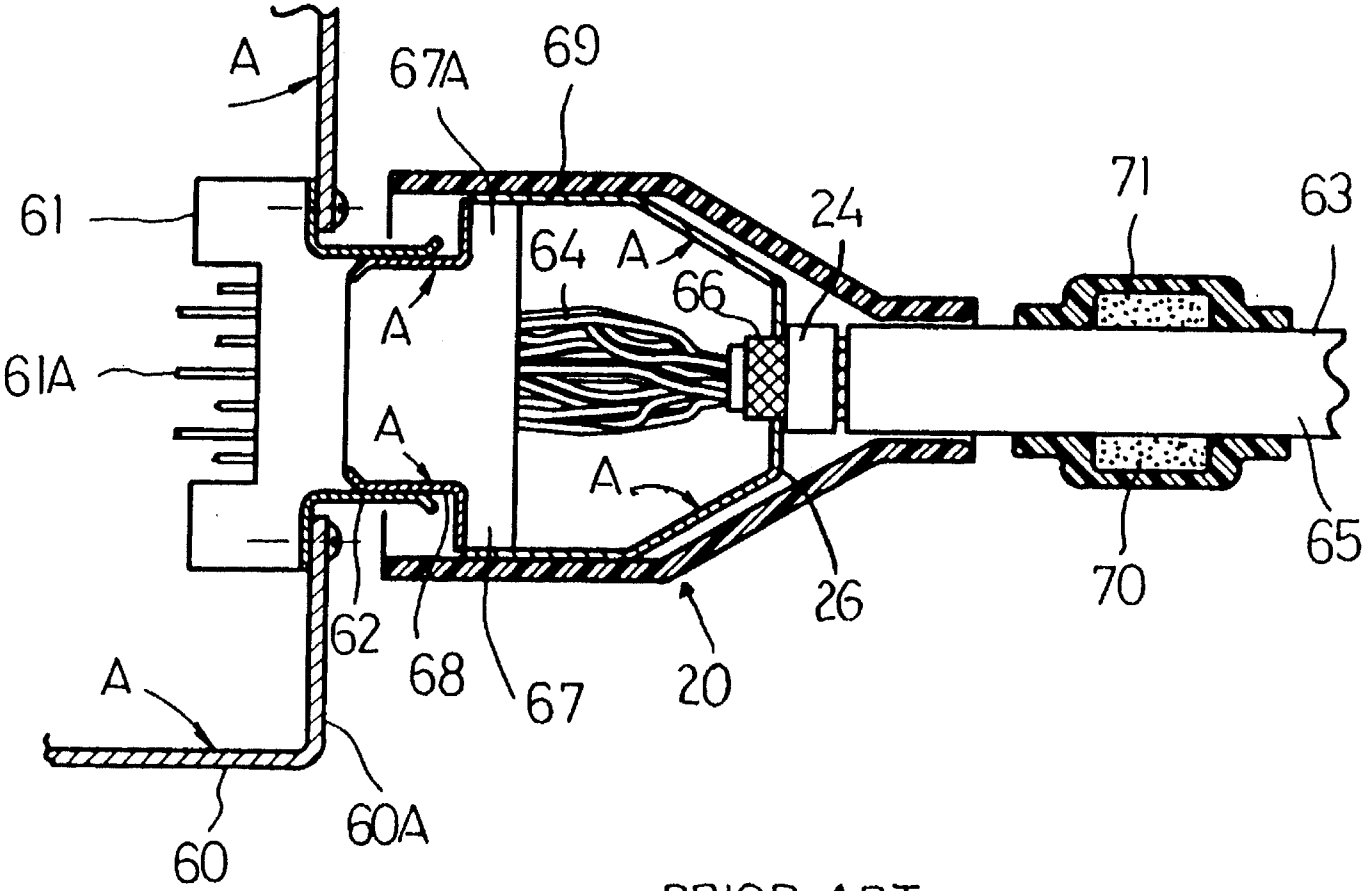
PRIOR ART FIG. 4

FIG. 4 illustrates a shielded plug assembly 20 representative of the prior art. The plug assembly is illustrated in alignment with and in partial connection with an electronic device 22 having an outer casing 60 with a connector receptacle, or female socket, 61 fixed to a sidewall 60A of the device casing 60. The receptacle 61 has a plug body portion 61A which extends inwardly from the casing and a metal shell 62 which extends outward therefrom and which surrounds the receptacle 61.

The plug assembly 20 includes an elongated interconnect cable 63 having a plurality of internal conductors 64 extending therethrough for the length of the cable 63 and which exit from an open end 24 of the cable 63. These internal conductors 64 are held within an insulative layer which is encircled for the length of the cable 63 by an EMF shielding layer, illustrated as metallic braiding 66. This braiding is further encircled with a conventional outer insulation 65.

As illustrated in FIG. 4, the cable conductors 64 have a series of free ends which extend out from the open end 24 of the cable 63 and which are connected to the plug end 67 of the plug assembly 20 in a manner such that each conductor 64 is terminated to a corresponding terminal of the plug end 67 (not shown). The plug end 67 has a metal shell 68 extending outward from a flange portion thereof 67A which includes a metal funnel-like shield 69 encircling the flange 67A and the braiding 66 exposed from the stripped end of the cable 63. The converging end 26 of the metal shield 69 is soldered to the braiding 66 without leaving any space therebetween so that the exposed conductors 64 are contained in the metal shield 69.

A ferrite ring 70 is typically applied to the outer insulation 65 of the cable 63 as illustrated, in order to suppress interference from the cable 63, and is fixed thereto by an annular tube 71 formed from a heat-shrink plastic, which is heated and shrunk around the ferrite ring 70. The cable 63 is connected to the electronic apparatus within the casing 60 by press-fitting the metal shell 68 of the plug assembly 20 into the metal shell 62 of the receptacle assembly 61.

In the conventional shielded plug-and-receptacle assembly described above and illustrated in FIG. 4, electromagnetic interference, or leakage of noise radiation "A", from the inside of the casing 60 is prevented by the casing itself 60, the metal shell 62 encircling the receptacle 61, the metal shell 68 encircling the plug 67 and the metal shield 69 in place within the plug housing. On the other hand, noise signals "B" may travel outward along the cable 63, and this interference may be absorbed by the ferrite ring 70 applied to the cable 63.

In addition to the metal shells 62 and 68 which encircle the plugs, the conventional shielded plug-and-receptacle assembly 20 requires extra parts, that is, the metal funnel-like shield 69 to prevent leakage of radiation noise "A", and the ferrite ring 70 to prevent leakage of traveling noise "B". In assembling these parts together to form the shielded plug assembly 20, it is necessary to: solder the converging end 26 of the metal shield 69 completely to the braiding 66 of the cable 63; and fix the ferrite ring 70 to the outer insulation of the cable by using extra assembly components, such as by heating and deforming a thermal-shrinkable tube 71 about the ferrite ring 70. This structure disadvantageously requires extra parts and extra assembling steps so that consequently the manufacturing cost of such an assembly 20 increases.

Figure 3:
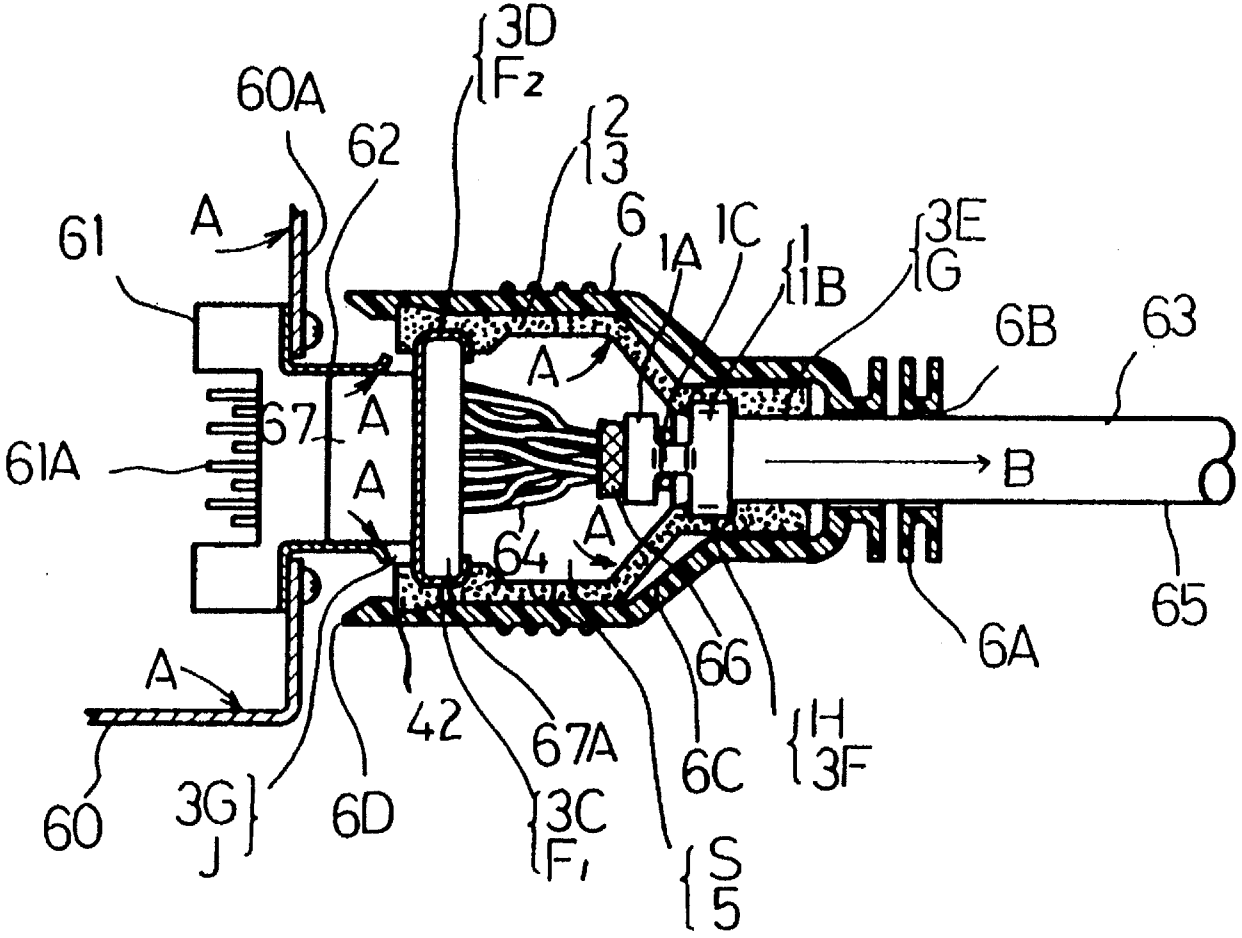
FIG. 3 is a plan sectional view of the shielded-plug assembly of FIG. 1 shown in alignment and in partial connection with an electronic device; and, FIG. 4 is a plan sectional of a conventional shielded-plug assembly illustrated in alignment and in partial connection with an electronic device.

Referring now to FIG. 3, a shielded plug assembly 30 constructed in accordance with the principles of the present invention is illustrated in partial connection with a receptacle 61 of an electronic device 60 defined by a sidewall 60A. The plug pins 61A of the receptacle 61 extend inward and the tubular metal shell 62 of the receptacle 61 extends outwardly from the side wall 60A of the casing 60. The receptacle 61 is connected to the electronic device contained in the casing 60. A transmission cable 63 is provided for interconnecting the device 60 with another device and contains a plurality of conductors 64, an inner insulation enclosing the conductors 64, a length of shielding in the form of a metal braiding 66 enclosing the inner insulation, and an outer insulation 65 enclosing the braiding 66.

As shown, the left end of the cable 63 is opened and stripped to partly expose its internal shielding braiding 66 so that the conductors 64 will protrude out from the cable and extend ahead of the exposed braiding 66. These exposed conductors 64 pass through the end flange 67A of the plug 31 on their way to connection to the plug pins 61A. The flange 67A may have a metal shell 68 formed thereto. The flange 67A may take any shape other than the rectangular shape illustrated, but the rectangular shape is preferable because it is symmetrical with respect to the internal casing 2 for assembly purposes.

An annular metal cable band 1 is provided to secure the open end of the cable 63 and includes first and second annular sections 1A and 1B which are interconnected together by a joint section 1C. The first annular section 1A binds the shielding braiding 66, and the second annular section 1B binds the outer insulation 65 of the cable 63. After binding the braiding 66 and the outer insulation 65 of the cable 63, the joint 1C is crimped so as to put the first and second annular sections 1A and 1B close to each other. As seen in FIG. 3, the second annular section 1B projects somewhat radially from the outer insulation 65 of the cable 63.

Figure 1:
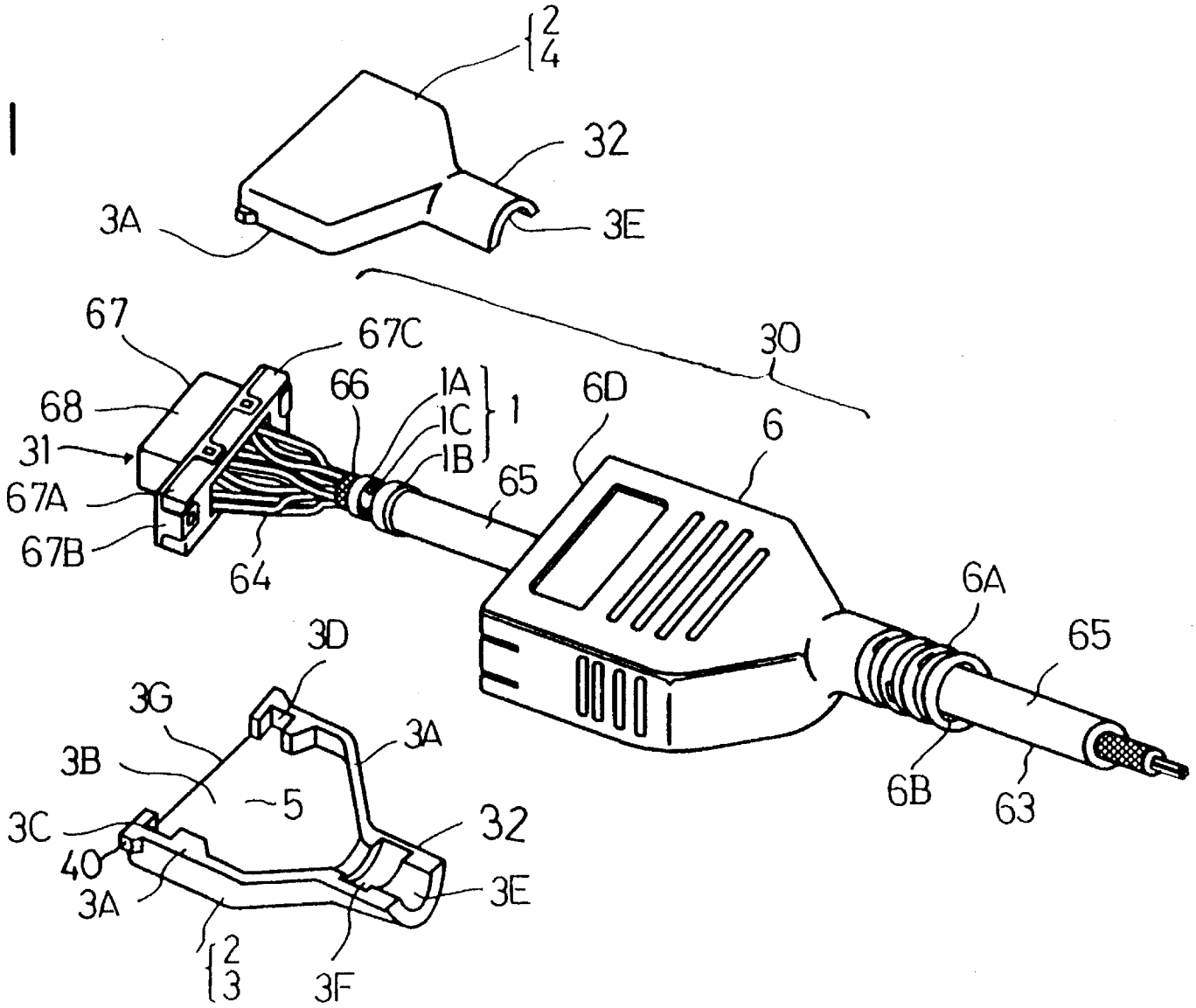
FIG. 1 is an exploded perspective view of a shielded-plug assembly constructed in accordance with the principles of the present invention.
Figure 2:
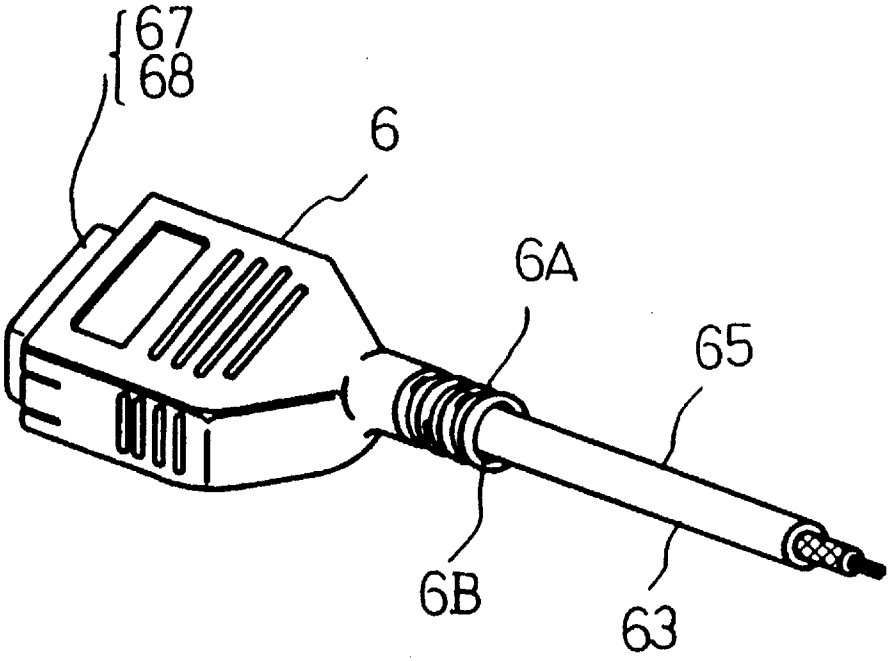
FIG. 2 is a perspective view of the shielded-plug assembly of FIG. 1 in an assembled state.

The shielded plug assembly 30 of the present invention also significantly includes an internal casing 2 made of a material which is capable of absorbing electromagnetic waves, that is, a material which is capable of shielding EMF radiation noise, such as ferrite. The internal casing 2 is composed of two separate halves 3 and 4, preferably identical in size and shape. As best seen in FIG. 1, one half 3 of the casing 2 comprises a bottom plate 3B and a Y-shaped side wall 3A integrally connected to the circumference of the bottom plate 3b which converges to a semi-cylindrical end 32. The Y-shaped side wall 3A defines a funnel-like enclosure 5, and the Y-shaped side wall 3A further includes rectangular slots 3C and 3D made in opposite ends thereof which accommodate the opposite end portions 67B and 67C of the flange 67A of the plug piece 67.

The semi-cylindrical end 32 of the Y-shaped side wall 3A has two semi-circular slots, or recesses 3E and 3F, which accommodate the outer insulation 65 of the cable 63 and the second annular section 1B of the metal band 1. These slots 3E and 3F open upward, and the enclosure 5 opens toward the diverging end to define an opening 3G extending between opposing recesses 3C, 3D which receive opposing ends of the metal shell 68 of the plug end 67 in the casing 2. The other half 4 of the casing 2 is preferably of the same size and shape as the half 3 just described.

As seen in FIGS. 1 and 3, a hollow covering 6 of synthetic resin has a cable inlet 6B shown at its right end and an outlet 6D shown at its left end in order to define a funnel-like cavity 6C therebetween. The flexible covering 6 is designed to accommodate the internal shielding casing 2 in a manner so that when the two halves 3, 4 thereof are assembled over the plug end 67 and inserted into the covering 6, they form an integrated plug assembly 30. As seen in FIG. 3, the covering 6 need not closely fit the entire circumference of the internal shielding casing 2 so that the outer open end of the cable 63 may be inserted into the cable inlet 6B of the covering 6. However, as illustrated in FIG. 3, the casing 2 may be provided with one or more tabs 40 near its open end which engage opposing interior rims 42 of the covering 6 in order to retain the covering 6 in place upon the casing 2.

In assembling the parts together into a shielded plug assembly 30, the exposed conductors 64 extending from the cable 63 are connected to their respective terminals of the plug end 67 after passing through the plug-end flange 67A. The first annular section 1A of the metal band 1 is then fixed circumferentially around the shielding braiding 66 and the second annular section 1B is fixed to the outer insulation 65 of the cable 63. Once so connected, the cable 63 becomes fixed to the plug end 67. Then, an unterminated end of the cable 63 (shown at right in FIG. 1) is inserted through the wire end 6A of the plastic covering 6, leaving the outlet end 6D of the plastic covering 6 apart from the metal band 1, as seen from FIG. 1.

The plug flange 67A, the exposed conductors 64, the metal band 1 and the stripped end of the cable 63 are thereupon held together in a sandwiching fashion between the two halves 3 and 4 of the internal shielding casing 2 by mating the two casing halves of the casing to each other. When mated together, the halves 3 and 4 cooperate to define the funnel-like enclosure 5. In this enclosure 5, rectangular spaces F1 and F2 (FIG. 3) are defined by the rectangular slots 3C and 3D of the casing 2 and accommodate the opposing end portions 67B and 67C of the plug flange 67A. The circular space H at the opposing end of the casing 2 is defined by the two semi-circular slots 3E and 3F and accommodates the second annular section 1B of the metal band 1. The plug end 67 is thereby maintained in place within an opening defined by the counter openings 3G of the two halves 3 and 4.

As described above, the stripped and banded end of the cable 63 is set in the cable inlet G; the second annular section 1B of the metal band 1 is put in the circular recess H; the first band 1A, the braiding 66 and the exposed conductors 64 are placed in the funnel-like enclosure S; and the opposing ends 67B and 67C of the plug flange 67A are placed into the rectangular spaces F1 and F2; and the two casing halves 3 are pressed together. The metal shell 68 of the plug end 67 projects out from. the opening J of the casing 2. Then, the covering 6 is then drawn over the casing assembly completely, thus automatically maintaining the casing halves 3, 4 in registration and close contact with each other.

The assembled casing halves 3, 4 are pressed and fixed together at selected portions such as at the flange 67A of the plug piece 67 and the terminal end of the outer insulation 65 of the cable 63 to present an integrated assembly. The shielded-plug assembly thus assembled can be connected to the female socket 61 of the device 60 by press-fitting the metal shell 68 of the plug assembly onto the metal shell 62 of the receptacle assembly 61.

The EMF radiation "A" emanating from the electronic device 60 (FIG. 3), contained in the casing 60 can be substantially shielded by the interconnection of metal shell 62 of the receptacle 61, the metal shell 68 of the plug end and the internal shielding casing 2. 0n the other hand, the traveling EMF radiation "B" can be prevented from interfering with the operation of the device 60 by the cylindrical portion of the shielding casing 2 which engages the outer insulation 65 of the cable 63 in the cable inlet G in a press-fit manner. Also, the circular recess H loaded with the second annular section 1B of the metal band 1, and the rectangular spaces F1 and F2 loaded with the opposite ends 67B and 67C of the flange 67A are effective to prevent the leaking of radiation noise.

Advantageously, this structure reduces the possibility of compromise or disassociation of the cable conductors 64 from their plug connection points when the cable 63 is bent or stretched during installation. The diverging end of the casing 2 (shown at right in FIG. 3) firmly receives the metal cable band 1B in its associated slot 3F while the open end of the casing 2 (shown at left in FIG. 3) firmly receives the flange 67A of the plug 67 and isolates them in their position by rigidly securing them in the casing such that any stretching or benching forces which may be applied to the cable 63 will not be applied directly to the exposed conductors 64 or the plug 67, and therefore, no adverse effect can be caused on the connection between the exposed conductors 64 and the plug 67.

As described earlier, the internal shielding casing 2 is composed of two separate halves 3 and 4 of the same size and shape, and therefore, these halves can be molded from one and same metal mold. Thus, the cost of manufacturing expensive metal molds can be reduced by half, and the cost of dealing with or managing and assembling such parts can be substantially reduced. The casing 2 may be coated with electrically conductive substance, for instance by electroless-plating nickel or nickel-phosphorus, thereby providing a shield effective for a wide frequency-range of EMF radiation.

Use of the plastic covering 6 facilitates integration of two separate halves 3 and 4 into a unitary casing 2, increases the mechanical strength of the shielded plug assembly, and further imparts a pleasing shape to the assembly. The shielded-plug assembly can be destaticized easily by applying antistatic agent to the surface of the plastic covering.

As may be understood from the above, a shielded plug assembly according to the present invention uses a casing composed of two separate halves of material which is capable of absorbing electromagnetic wave, enclosing its flanged plug, the exposed conductors of an associated cable, a metal band binding the exposed braiding and the stripped end of the cable. The flange of the plug piece and the stripped end of the cable are pinched between the two separate halves when inserted into a plastic covering.

The shielded plug assembly structure has advantageous effects as follows: leakage of the radiation and traveling noise can be completely prevented; reduction of the number of parts facilitates assembling work, and contributes reduction of manufacturing costs; the fixing of the flanged plug piece and the stripped end of the cable by inserting into corresponding recesses of the casing has the effects of increasingly shielding effect of radiation and traveling noise, and of preventing the direct application of detrimental stretching or bending forces to the connection between the exposed conductors of the cable and the plug piece; a single metal mold can be used to mold separate casing halves, accordingly reducing the manufacturing cost; the shielding effect can be improved simply by coating the casing with electrically conductive substance; use of a plastic covering facilitates integration of two separate halves into unitary casing; and the plug assembly can be easily destaticized simply by applying antistatic agent to the plastic covering.

Although the present invention has been described in terms of interconnection cables, it will be appreciated that the present invention will bring substantially the same benefits to other cables as well. Accordingly, it will be appreciated that the embodiments of the present invention have discussed herein are merely illustrative of a few applications of the principles of the invention. Numerous modifications may be made by those skilled in the art without departing from the true spirit and scope of the invention.

We claim:

1. A shielded plug assembly for use on the end of an electrical cable which is adapted for electrically connecting two electronic devices together, the shielded plug assembly comprising: a length of cable, the cable having a plurality of internal electrical conductors extending axially therethrough, the conductors being enclosed within said cable by an outer electrical insulation layer, said cable further including a layer of electrical shielding material extending the length of said cable and disposed between said conductors and said outer insulation layer, said cable having an open end at which said conductors protrude out from said cable; a plug member for connecting said cable to one of said two electronic devices, the plug member having a body portion adapted to engage a receptacle portion of said electronic device, the plug member body portion having a flange member disposed thereon and a plurality of connection points which are connected to said internal conductors protruding from said cable; a shielding casing formed from an electromagnetic shielding material, the shielding casing having two opposing end portions, one of the two casing end portions engaging said plug member flange member and the other of said two casing end portions engaging said cable open end such that said casing substantially encloses said plug member flange member, said internal conductors protruding from said cable and said cable open end and isolates said plug member flange member and said cable open end from movement relative to each other; and, a resilient, flexible covering enclosing said shielding casing and a body of said cable adjacent said cable open end, the flexible covering extending from the cable body to partially past said plug member flange member, said flexible covering having an inner rim disposed thereon proximate to said plug member flange member, said shielding casing further including at least one flexible covering means in the form of an engagement tab disposed proximate said one end portion thereof and extending outwardly from said shielding casing in confronting relationship to said flexible covering inner rim and abuttingly engaging said flexible covering rim, said tab and rim together cooperating to maintain and retain said shielding casing in place within said covering.

2. The shielded plug assembly as defined in claim 1, wherein said shielding casing is formed from ferrite.

3. The shielded plug assembly as defined in claim 1, wherein said shielding casing is coated with an electrically conductive coating.

4. The shielded plug assembly as defined in claim 1, wherein said cable open end includes a band applied thereto which fixes said cable shielding material to said outer insulation layer and said shielding casing includes a recess at said other end portion thereof which receives said cable band.

5. The shielded plug assembly as defined in claim 1, wherein said shielding casing one end portion is wider than said shielding casing other end portion and said flexible covering snugly engages said shielding casing.

6. The shielded plug assembly as defined in claim 1, wherein said shielding casing includes two interconnecting half portions.

7. The shielded plug assembly as defined in claim 6, wherein said shielding casing two interconnecting half portions are substantially identical half portions.

8. An improved shielded plug assembly for an interconnect cable used for electrically connecting two electronic devices together, the interconnect cable having a plurality of internal conductors enclosed within an outer insulative covering, the cable including a length of electromagnetic shielding material disposed between said internal conductors and said outer insulative covering, said cable further including an open end at which said internal conductors are exposed and protrude out from said cable, said plug assembly including a plug end for connecting said cable to said electronic device, the plug end including a plug member, the plug member having an plug engagement flange disposed thereon, said plug member having front and rear working surfaces disposed on opposite sides of said plug member engagement flange, said plug member further having a plurality of connection points disposed along said plug member rear working surfaces to which said exposed internal conductors are attached, said assembly further including an outer flexible covering enclosing said cable open end and said exposed internal conductors, the improvement comprising: means for interconnecting said cable open end and said plug member together and for electromagnetically shielding said plug member connection points, said exposed internal conductors and said cable open end, the interconnecting and shielding means including an internal casing formed from an electromagnetic shielding material and disposed within said flexible covering, the internal casing having two opposing ends, one of said internal casing ends fixedly engaging an exterior surface of said cable outer insulative covering at said cable open end, and the other of said internal casing ends fixedly engaging an exterior surface of said plug member engagement flange, whereby said fixed engagement between said internal casing and said exterior surfaces of said cable outer insulative covering and said plug member plug engagement flange protects said attachments between said internal conductors and plug member connection points from disassociation due to flexure of one of said plug member and said cable by substantially preventing relative movement therebetween to thereby prevent detrimental forces from being applied to said plug member connection points and said internal conductors when said plug assembly is manipulated by a user, said internal casing further providing a shielded enclosure which encloses: said plug member plug engagement flange, said plug member connection points, said exposed internal conductors and said cable open end.

9. The improved shielded plug assembly as defined in claim 8, wherein said cable further includes a metal band proximate said open end thereof which engages said cable outer insulative covering, said internal casing including a first recess which receives the metal band and fixes said cable open end in place within said internal casing by substantially enclosing all exterior surfaces of said metal band and a portion of said cable outer insulative covering exterior surface adjacent thereto within said internal casing.

10. The improved shielded plug assembly as defined in claim 9, wherein said internal casing includes a second recess which receives said plug member engagement flange therein and fixes said plug member in place within said casing by substantially enclosing all exterior surfaces of said plug member engagement flange, the second recess being spaced apart from said first recess.

11. The improved shielded plug assembly as defined in claim 8, wherein said flexible covering includes an antistatic coating.

12. The improved shielded plug assembly as defined in claim 8, wherein said flexible covering snugly engages said internal casing.

13. The improved shielded plug assembly as defined in claim 12, wherein said internal casing includes at least one tab member protruding out from said internal casing and said internal casing includes an interior rim which engages said tab member to assist in retaining said flexible covering over said internal casing.

14. The improved shielded plug assembly as defined in claim 12, wherein said internal casing includes a pair of recesses disposed therein at said opposing ends of said internal casing, one of said recesses receiving said plug member flange member by substantially engaging all exterior surfaces of said plug member engagement flange and the other of said recesses receiving a band attached to said cable outer insulative covering at said cable open end by substantially engaging all exterior surfaces of said band, said two recesses preventing relative movement of said plug member and said cable open end, thereby isolating said connections between said exposed internal conductors and said plug member from external forces.

15. The improved shielded plug assembly as defined in claim 14, wherein said recesses rigidly hold said plug member and said cable open end within said internal casing.

16. The improved shielded plug assembly as defined in claim 8, wherein said internal casing one end is generally tubular in configuration and snugly receives said cable open end therein such that interior surfaces of said internal casing one end substantially abut said cable outer insulative covering exterior surface, and wherein said other of said internal casing ends is generally rectangular in configuration and is wider than said internal casing one end and snugly receives said plug member engagement flange therein such that interior surfaces of said internal casing other end substantially abut exterior surfaces of said plug engagement flange, said internal casing diverging in its width from said one casing end to said other casing end and thereby defining a shielded enclosure extending between said plug member engagement flange and a portion of said cable at said cable open end.

17. A shielded plug assembly for use on the end of an electrical cable which is adapted for electrically connecting two electronic devices together, the cable having a plurality of internal electrical conductors extending axially therethrough, the conductors being enclosed within said cable by an outer electrical insulation layer, said cable further including a layer of electrical shielding material extending along its length and disposed between said conductors and said outer insulation layer, said cable having an open end at which said conductors protrude out from said cable, said shielded plug assembly comprising: a plug member adapted to connect said cable to one of said two electronic devices, the plug member having a body portion adapted to engage a receptacle portion of said electronic device, the plug member body portion having a flange member disposed thereon which defines an exterior perimeter surface extending around said plug member body portion and a plurality of connection points to be connected to said internal conductors protruding from said cable, a shielding casing formed from a cast ferrite electromagnetic shielding material, the shielding casing having first and second opposing end portions, the first casing end portion engaging substantially all of the exterior perimeter surface of said plug body portion flange member and the second casing end portion adapted to engage an exterior surface of said cable outer insulation layer near said cable open end such that said shielding casing substantially encloses said plug member flange member, said internal conductors protruding from said cable and said cable open end and said shielding casing by preventing relative movement between said plug member flange member and said cable open end, thereby isolating said connections between said exposed internal conductors and said plug member from external forces and a flexible, protective sheath covering said cable open end and said shielding casing.

18. The shielded plug assembly as defined in claim 17, wherein said cable includes a termination band applied to said cable outer insulation layer exterior surface, the termination band extending from said cable outer insulation layer exterior surface to said cable electrical shielding material, said shielding casing including a channel formed therein at said second end portion which abuttingly engages and completely envelops said termination band.

19. The shielded plug assembly as defined in claim 17, wherein said shielding casing includes two engagement tabs extending outwardly therefrom and disposed on opposite sides of a centerline of said shielding casing, said protective sheath having an interior interference member disposed thereon in confronting relationship with said engagement tabs.

* * * * *